US010433056B2

(12) United States Patent
Faller et al.

(10) Patent No.: US 10,433,056 B2
(45) Date of Patent: Oct. 1, 2019

(54) AUDIO SIGNAL PROCESSING STAGE, AUDIO SIGNAL PROCESSING APPARATUS, AUDIO SIGNAL PROCESSING METHOD, AND COMPUTER-READABLE STORAGE MEDIUM

(71) Applicant: Huawei Technologies Co., Ltd., Shenzhen (CN)

(72) Inventors: Christof Faller, Uster (CH); Alexis Favrot, Uster (CH); Peter Grosche, Munich (DE); Martin Pollow, Munich (DE); Jürgen Geiger, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/197,696

(22) Filed: Nov. 21, 2018

(65) Prior Publication Data

US 2019/0098407 A1 Mar. 28, 2019

Related U.S. Application Data

(63) Continuation of application No. PCT/EP2016/061782, filed on May 25, 2016.

(51) Int. Cl.
*H04R 3/04* (2006.01)
*H04R 3/00* (2006.01)

(52) U.S. Cl.
CPC ..... *H04R 3/04* (2013.01); *H04R 3/007* (2013.01); *H04R 2430/03* (2013.01); *H04S 2400/09* (2013.01)

(58) Field of Classification Search
None
See application file for complete search history.

(56) References Cited

U.S. PATENT DOCUMENTS 5,359,665 A 10/1994 Werrbach
5,832,444 A 11/1998 Schmidt
(Continued)

FOREIGN PATENT DOCUMENTS

CN 1477904 A 2/2004
CN 101964190 A 2/2011
(Continued)

OTHER PUBLICATIONS

Dutilleux et al., "Nonlinear processing," DAFX—Digital Audio Effects, 2nd Ed., Chapter 4, John Wiley & Sons, Inc., pp. 1-38 (2002).

(Continued)

*Primary Examiner* — Curtis A Kuntz
*Assistant Examiner* — Kenny H Truong
(74) *Attorney, Agent, or Firm* — Leydig, Voit & Mayer, Ltd.

(57) ABSTRACT

An input audio signal is separated into input audio signal components (X(k,b)). A set of two or more band branches provides output audio signal components (Y(k,b)). The set of band branches comprises one or more compressor branches Each compressor branch compresses a respective input audio signal component (X(k,b)) into a respective output audio signal component (Y(k,b)). A summed audio signal (y(t)) is generated by summing the output audio signal components (Y(k,b)). A residual audio signal (v(t)) is a difference between the input audio signal and the summed audio signal(y(t)) A virtual bass signal (w(t)) comprises one or more harmonics of the residual audio signal (v(t)). An output audio signal is generated by summing the summed audio signal (y(t)) and the virtual bass signal (w(t)).

15 Claims, 9 Drawing Sheets

(56) References Cited

U.S. PATENT DOCUMENTS

| | | | | |
|---|---|---|---|---|
| 6,792,115 | B1 | 9/2004 | Vierthaler | |
| 7,233,833 | B2 | 6/2007 | Little | |
| 7,394,908 | B2 | 7/2008 | Katou et al. | |
| 8,094,835 | B2 | 1/2012 | Shimura et al. | |
| 8,386,242 | B2 | 2/2013 | Kim et al. | |
| 8,638,953 | B2 | 1/2014 | Jonsson et al. | |
| 8,873,763 | B2 | 10/2014 | Tsang | |
| 9,154,875 | B2 | 10/2015 | Van Reck | |
| 2004/0022400 | A1 | 2/2004 | Magrath | |
| 2006/0159283 | A1 | 7/2006 | Mathew et al. | |
| 2011/0002467 | A1 | 1/2011 | Nielsen | |
| 2011/0044471 | A1* | 2/2011 | Aarts | H04R 3/04 381/98 |
| 2011/0091048 | A1 | 4/2011 | Bai et al. | |
| 2011/0280407 | A1 | 11/2011 | Skinner et al. | |
| 2012/0016667 | A1 | 1/2012 | Gao | |
| 2013/0163784 | A1 | 6/2013 | Tracey et al. | |
| 2016/0212533 | A1* | 7/2016 | Risberg | H04R 3/04 |

FOREIGN PATENT DOCUMENTS

| | | | |
|---|---|---|---|
| CN | 102007777 | A | 4/2011 |
| CN | 102724605 | A | 10/2012 |
| CN | 102771145 | A | 11/2012 |
| CN | 103026408 | A | 4/2013 |
| EP | 0972426 | B1 | 1/2003 |
| EP | 1110427 | B1 | 8/2004 |
| EP | 2278707 | A1 | 1/2011 |
| EP | 2522156 | B1 | 8/2014 |
| WO | 2013076223 | A1 | 5/2013 |

OTHER PUBLICATIONS

Larsen et al., "Audio Bandwidth Extension, Application of Psychoacoustics, Signal Processing and Loudspeaker Design," John Wiley & Sons, Inc., pp. 1-313 (2004).

Glasberg et al., "Derivation of auditory filter shapes from notched-noise data," Hearing Research, vol. 47, pp. 103-138 (Sep. 1990).

* cited by examiner

AUDIO SIGNAL PROCESSING STAGE, AUDIO SIGNAL PROCESSING APPARATUS, AUDIO SIGNAL PROCESSING METHOD, AND COMPUTER-READABLE STORAGE MEDIUM

CROSS-REFERENCE TO RELATED APPLICATIONS

This application is a continuation of International Application No. PCT/EP2016/061782, filed on May 25, 2016, the disclosure of which is hereby incorporated by reference in its entirety.

TECHNICAL FIELD

Embodiments of the invention relate to the field of audio signal processing. In particular, the embodiments of the invention relate to an audio signal processing stage, an audio signal processing apparatus and an audio signal processing method which allow enhancing an audio signal for reproduction by a loudspeaker.

BACKGROUND

Many loudspeakers, especially smaller ones, are not capable of faithfully reproducing low-frequency content of an input audio signal. A reason is that the excursion (i.e. displacement) of the membrane is limited. Generally, the sound pressure level L of a loudspeaker depends on the geometry of the loudspeaker and on the frequency f of the electrical excitation signal according to the following relation:

$$L(r) = 20\log_{10} x_m S_m \frac{\rho_0}{p_0\sqrt{2}\,r} f^2, \tag{1}$$

wherein $x_m$ denotes the excursion of the loudspeaker membrane, $S_m$ denotes the area of the loudspeaker membrane, $\rho_0$ denotes the density of air and $p_0$ denotes the reference sound pressure, commonly equal to 20 μPa. From equation 1, it follows that loudspeakers of small size, i.e. small $S_m$, will have a limited sound pressure level. Especially at low frequencies the sound pressure level can be degraded, having the effect that the reproduction of music with bass can suffer from distortions. Furthermore, overdriven loudspeakers tend to be less power-efficient in that they have a lower ratio of the input power to the output acoustic power.

One approach to avoiding or reducing loudspeaker saturation or distortion, especially at low frequencies, involves frequency attenuation techniques. For example, U.S. Pat. No. 7,233,833 discloses a method which uses a static filter (high-pass or low-shelving) to truncate an audio signal below a predefined frequency. The low-passed signal is fed to a virtual bass unit to generate harmonics of the low-passed signal. The harmonics are added to the truncated signal, and the resulting signal is passed on to the loudspeaker.

Another approach uses an amplitude-adaptive attenuation method in which low frequencies are dynamically attenuated in such a way that the loudspeaker does not saturate. An amplitude-adaptive attenuation is known in the art as compression. Similarly, a compressor is a device for compressing a signal, i.e., for dynamically controlling a gain of the signal (or gains of selected spectral components of the signal). U.S. Pat. No. 5,832,444, for instance, discloses a compressor which is applied to a low frequency band.

Existing solutions for preventing loudspeaker saturation or overdrive effects have some deficiencies. Notably, a static cut-off filter will often attenuate the low frequency spectrum more strongly than necessary. Existing adaptive equalization methods, on the other hand, can result in a perceivable loss of low frequency content.

SUMMARY

It is an object of the present embodiments to provide for improved audio signal processing devices and methods, in particular, devices and methods which prevent saturation or overdrive effects of loudspeakers, especially at low frequencies.

The foregoing and other objects are achieved by the subject matter of the independent claims. Further implementation forms are apparent from the dependent claims, the description and the figures.

According to a first aspect, the invention relates to an audio signal processing stage for processing an input audio signal into an output audio signal, for preventing overdriving a loudspeaker. The audio signal processing stage comprises: a filter bank defining two or more frequency bands, the filter bank being configured to separate the input audio signal into two or more input audio signal components, each of the input audio signal components being limited to a respective one of the two or more frequency bands; a set of two or more band branches configured to provide two or more output audio signal components, wherein each of the band branches is configured to provide a respective one of the output audio signal components, wherein the set of two or more band branches comprises one or more compressor branches, each of the one or more compressor branches comprising a compressor configured to compress the input audio signal component of the respective compressor branch to provide the output audio signal component of the respective compressor branch; an inverse filter bank configured to generate a summed audio signal by summing the two or more output audio signal components; a residual audio signal generating unit (also referred to as summation unit) configured to generate a residual audio signal, the residual audio signal being a difference between the input audio signal and the summed audio signal; a virtual bass unit configured to generate a virtual bass signal which comprises one or more harmonics of the residual audio signal, the virtual bass unit comprising a harmonics generator (e.g., a frequency multiplier) configured to generate the one or more harmonics on the basis of the residual audio signal; and a summation unit configured to generate the output audio signal by summing the summed audio signal and the virtual bass signal. The one or more compressor branches have the effect of making it less likely for the output signal to produce overdrive effects when the output signal is fed to a loudspeaker.

According to a second aspect, the invention relates to an audio signal processing stage for processing an input audio signal into an output audio signal, for preventing overdriving a loudspeaker. The audio signal processing stage according to the second aspect comprises: a filter bank defining two or more frequency bands, the filter bank being configured to separate the input audio signal into two or more input audio signal components, each of the input audio signal components being limited to a respective one of the two or more frequency bands; a set of two or more band branches configured to provide two or more output audio signal components, wherein each of the band branches is configured to process a respective one of the input audio signal components to provide a respective one of the output audio signal components; and an inverse filter bank configured to generate the output audio signal by summing the two or more output audio signal components. The set of two or more band branches comprises one or more compressor branches, each of the compressor branches comprising: a compressor configured to generate a compressed audio signal component by compressing the input audio signal component of the respective compressor branch; a residual audio signal component generating unit (also referred to as summation unit) configured to generate a residual audio signal component, the residual audio signal component being a difference between the input audio signal component of the respective compressor branch and the compressed audio signal component; a virtual bass unit configured to generate a virtual bass signal component which comprises one or more harmonics of the residual audio signal component, the virtual bass unit comprising a harmonics generator (e.g., a frequency multiplier) configured to generate the one or more harmonics on the basis of the residual audio signal component; and a summation unit configured to generate the output audio signal component of the respective compressor branch by summing the compressed audio signal component and the virtual bass signal component. The one or more compressor branches have the effect of making it less likely for the output signal to produce overdrive effects when the output signal is fed to a loudspeaker.

In a first implementation form of the audio signal processing stage according to the first aspect as such or the audio signal processing stage according to the second aspect as such, the set of two or more band branches further comprises one or more non-compressive branches. In the present disclosure, a non-compressive branch is defined as a branch that does not compress the input audio signal component of that branch. A non-compressive branch may also be referred to as a neutral branch. A non-compressive (or neutral) branch may be implemented, for example, in the form of a direct conductive connection, e.g., a wire connection. A non-compressive branch provides an economic implementation for processing an input audio signal component that does not require compression.

In a second implementation form of the audio signal processing stage according to the first aspect as such or the first implementation form thereof or the audio signal processing stage according to the second aspect as such or the first implementation form thereof, the set of two or more band branches comprises precisely one, i.e. only one, not more than one compressor branch. Such design may be particularly economic, in particular when the audio signal processing stage is one of several (i.e. two or more) stages connected in series. In operation, the stages connected in series process the audio signal sequentially, e.g., performing compression and virtual bass compensation for precisely one frequency band in each stage. The frequency bands thus associated with the various stages (one frequency band being subjected to compression in each stage) may increase in frequency in the order of the stages to ensure that harmonics generated in the first stage (or in a later stage) will not overdrive the loudspeaker.

In a third implementation form of the audio signal processing stage according to the first aspect as such or the first or second implementation form thereof or the audio signal processing stage according to the second aspect as such or the first or second implementation form thereof, the virtual bass unit further comprises a timbre correction filter configured to apply a timbre correction to the one or more harmonics. The perceived audio quality of the output audio signal can thus be improved.

In a fourth implementation form of the audio signal processing stage according to the first aspect as such or any one of the first to third implementation form thereof or the audio signal processing stage according to the second aspect as such or any one of the first to third implementation form thereof, the compressor comprises a compressor gains unit, a compressor threshold unit and a loudspeaker modelling unit. The audio signal processing stage can thus be adapted to certain loudspeaker characteristics by an appropriate configuration of the compressor gains unit, the compressor threshold unit, and the loudspeaker modeling unit, e.g., at a factory. Preferably, these units are programmable; in this case, they can be re-configured for different loudspeaker characteristics, e.g., at the initiative of a user.

In a fifth implementation form of the audio signal processing stage according to the first aspect as such or any one of the first to fourth implementation form thereof or the audio signal processing stage according to the second aspect as such or any one of the first to fourth implementation form thereof, the harmonics of the residual audio signal or the harmonics of the residual audio signal component comprise one or more even harmonics. This can be achieved by an appropriate design of the harmonics generator. Such design can be simpler compared to one for generating even as well as odd harmonics. For example, the harmonics generator may comprise or consist of a second order multiplier. Preferably, the harmonics of the residual audio signal or the harmonics of the residual audio signal component comprise at least the second harmonic (i.e. the lowest possible harmonic) of the residual audio signal or residual audio signal component, respectively.

In a sixth implementation form of the audio signal processing stage according to the fifth implementation form of the first aspect or the audio signal processing stage according to the fifth implementation form of the second aspect, the harmonics of the residual audio signal or the harmonics of the residual audio signal component comprise one or more odd harmonics. For example, the harmonics generator may be configured to generate the one or more odd harmonics of the residual audio signal or the residual audio signal component on the basis of the even harmonics using a soft clipping algorithm. The perceived audio quality can thus be improved.

In a seventh implementation form of the audio signal processing stage according to the first aspect as such or any one of the first to sixth implementation forms thereof, the virtual bass unit further comprises one or both of a low pass filter and a high pass filter, wherein the low pass filter is connected between the residual audio signal generating unit and the harmonics generator and wherein the high pass filter is connected between the harmonics generator and the summation unit. The perceived audio quality can thus be improved.

In an eighth implementation form of the audio signal processing stage according to the seventh implementation form of the first aspect, the compressor is configured to adjust one or both of a cut-off frequency of the low pass filter or a cut-off frequency of the high pass filter. The perceived audio quality can thus be optimized.

According to a third aspect, the invention relates to an audio signal processing apparatus comprising a first and a second audio signal processing stage according to the first aspect as such or any one of its implementation forms or according to the second aspect as such or any one of its implementation forms, wherein the first and second audio signal processing stages are connected in series, the output audio signal of the first audio signal processing stage (first stage) being the input audio signal of the second audio signal processing stage (second stage). More generally, several (i.e. two or more) audio signal processing stages may be connected in series, for a sequential processing of the audio signal. In one example, which may be particularly economic and performant, each stage applies compression and virtual bass compensation to precisely one frequency band. That frequency band (i.e. the one in which compression is performed) may be referred to as the compression band of the respective stage. The compression bands thus associated with the various stages may increase in frequency in the order of the series of stages. In other words, the compression band of a given stage may be higher than the compression band of the preceding stage. It can thus be ensured that harmonics generated in a given stage will be compressed in one of the subsequent stages. Overdriving the loudspeaker by the harmonics can thus be avoided.

In a first implementation form of the audio signal processing apparatus according to the third aspect of the invention, the one or more frequency bands defined by the filter bank of the second audio signal processing stage comprise all or some of the harmonics generated in the first audio signal processing stage. Overdriving the loudspeaker by harmonics from the first audio signal processing stage can thus be avoided. In one example, the set of band branches of the first stage comprises a compressor branch configured to compress the input audio signal of the first stage in a first frequency band [f1, f2] (with a lower frequency limit f1 and an upper frequency limit f2); the harmonics generator of the virtual bass unit of the first stage comprises a frequency doubler; and the set of band branches of the second stage comprises a compressor branch configured to compress the input audio signal of the second stage in a second frequency band [2*f1, 2*f2].

According to a fourth aspect, the invention relates to an audio signal processing method for processing an input audio signal into an output audio signal, wherein the audio signal processing method comprises: separating the input audio signal into two or more input audio signal components by means of a filter bank, the filter bank defining two or more frequency bands, each input audio signal component being limited to a respective one of the frequency bands; providing two or more output audio signal components on the basis of the two or more input audio signal components by means of two or more band branches, wherein each of the two or more band branches provides a respective one of the output audio signal components on the basis of a respective one of the input audio signal components, wherein the set of two or more band branches comprises one or more compressor branches, each of the one or more compressor branches comprising a compressor that compresses the input audio signal component of the respective compressor branch to provide the output audio signal component of the respective compressor branch; generating a summed audio signal by summing the two or more output audio signal components; generating a residual audio signal, the residual audio signal being a difference between the input audio signal and the summed audio signal; generating a virtual bass signal which comprises one or more harmonics of the residual audio signal by generating the one or more harmonics on the basis of the residual audio signal; and generating the output audio signal by summing the summed audio signal and the virtual bass signal. Using the two or more compressor branches in this manner has the effect of making it less likely for the output signal to produce overdrive effects when the output signal is fed to a loudspeaker.

The audio signal processing method according to the fourth aspect of the invention can be performed by the audio signal processing stage according to the first aspect of the invention. Further features of the audio signal processing method according to the fourth aspect of the invention result directly from the functionality of the audio signal processing stage according to the first aspect of the invention and its various implementation forms.

According to a fifth aspect, the invention relates to an audio signal processing method for processing an input audio signal into an output audio signal, wherein the audio signal processing method comprises: separating the input audio signal into two or more input audio signal components by means of a filter bank, the filter bank defining two or more frequency bands, each of the two or more input audio signal components being limited to a respective one of the two or more frequency bands; providing two or more output audio signal components on the basis of the two or more input audio signal components by means of a set of two or more band branches, wherein each of the band branches provides a respective one of the output audio signal components on the basis of a respective one of the input audio signal components, wherein the set of two or more band branches comprises one or more compressor branches, each of the one or more compressor branches comprising: a compressor which generates a compressed audio signal component by compressing the input audio signal component of the respective compressor branch; a residual audio signal component generating unit which generates a residual audio signal component, the residual audio signal component being a difference between the input audio signal component of the respective compressor branch and the compressed audio signal component of the respective compressor branch; a virtual bass unit which generates a virtual bass signal component comprising one or more harmonics of the residual audio signal component, by generating the one or more harmonics on the basis of the residual audio signal component; and a summation unit which generates the output audio signal component of the respective compressor branch by summing the compressed audio signal component and the virtual bass signal component; and generating the output audio signal by summing the two or more output audio signal components. Using the more or more compressor branches in this manner has the effect of making it less likely for the output signal to produce overdrive effects when the output signal is fed to a loudspeaker.

The audio signal processing method according to the fifth aspect of the invention can be performed by the audio signal processing stage according to the second aspect of the invention. Further features of the audio signal processing method according to the fifth aspect of the invention result directly from the functionality of the audio signal processing stage according to the second aspect of the invention and its various implementation forms.

According to a sixth aspect, the invention relates to a computer program or a data carrier carrying the computer program. The computer program comprises program code for performing the method according to the fourth aspect or the fifth aspect of the invention when executed on a computer.

The embodiments of the invention can be implemented in hardware, in software, and in a combination of hardware and software.

BRIEF DESCRIPTION OF THE DRAWINGS

Further embodiments of the invention will be described with respect to the following figures, wherein.

In the figures, identical reference signs will be used for identical or functionally equivalent features.

DETAILED DESCRIPTION OF EMBODIMENTS

In the following description, reference is made to the accompanying drawings, which form part of the disclosure, and in which are shown, by way of illustration, specific aspects in which the present invention may be placed. It will be appreciated that the invention may be placed in other aspects and that structural or logical changes may be made without departing from the scope of the invention. The following detailed description, therefore, is not to be taken in a limiting sense, and the scope of the invention is defined by the appended claims.

For instance, it will be appreciated that a disclosure in connection with a described method will generally also hold true for a corresponding device or system configured to perform the method and vice versa. For example, if a specific method step is described, a corresponding device may comprise a unit to perform the described method step, even if such unit is not explicitly described or illustrated in the figures.

Moreover, in the following detailed description as well as in the claims, embodiments with functional blocks or processing units are described, which are connected with each other or exchange signals. It will be appreciated that the invention also covers embodiments which include additional functional blocks or processing units, such as pre- or post-filtering and/or pre- or post-amplification units, that are arranged between the functional blocks or processing units of the embodiments described below. The various functional blocks or processing units may be embodied as one or more microprocessors.

Finally, it is understood that the features of the various exemplary aspects described herein may be combined with each other, unless specifically noted otherwise.

Figure 1:
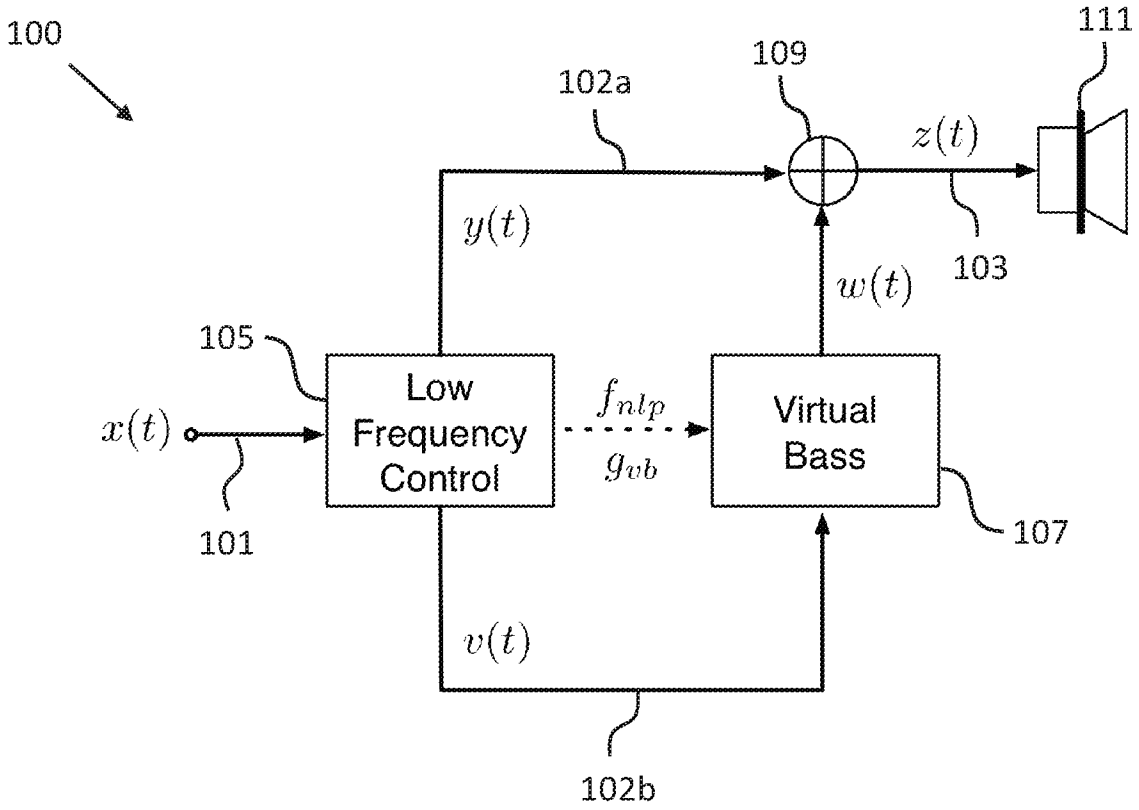
FIG. 1 shows a schematic diagram of an audio signal processing stage, comprising a low frequency control unit and a virtual bass unit.

FIG. 1 shows a schematic diagram of an audio signal processing stage 100 configured to process an input audio signal. More specifically, the audio signal processing stage 100 is configured to process the input audio signal x(t) 101 into an output audio signal z(t) 103. The audio signal processing stage 100 comprises a low frequency control unit 105, which is configured to compress the input audio signal x(t) 101, at least within a low-frequency range, thereby generating a compressed audio signal y(t) 102*a*. Feeding the compressed audio signal y(t) 102*a*, rather than the input audio signal x(t) 101, to a loudspeaker 111 can reduce or eliminate distortions of the loudspeaker 111. The low-frequency range may, for example, be the range of frequencies below 300 Hz, below 200 Hz, or below 100 Hz.

The audio signal processing stage 100 further comprises a virtual bass unit 107, which is configured to compensate, at least partially, for the amplitude loss at low frequencies that results from compressing the input audio signal x(t) 101. More specifically, the virtual bass unit 107 is configured to receive as input a residual signal v(t) 102*b*, which is the difference between the compressed signal y(t) 102*a* and the input audio signal x(t) 101, i.e. $v(t)=x(t)-y(t)$, and is configured to produce new signal components, e.g., using a harmonics generator, for creating the perception of a "virtual bass". For example, as indicated by the dashed line in FIG. 1, the virtual bass unit 107 may be configured to create the perception of a "virtual bass" on the basis of, e.g., one or more of a cut-off frequency and a plurality of weighting coefficients provided by the low frequency control unit 105. The output signal w(t) from the virtual bass unit 107 is summed with the output signal y(t) from the low frequency control unit 105 in a summation unit 109. The resulting output audio signal z(t) 103 can be reproduced by the loudspeaker 111.

Figure 2:
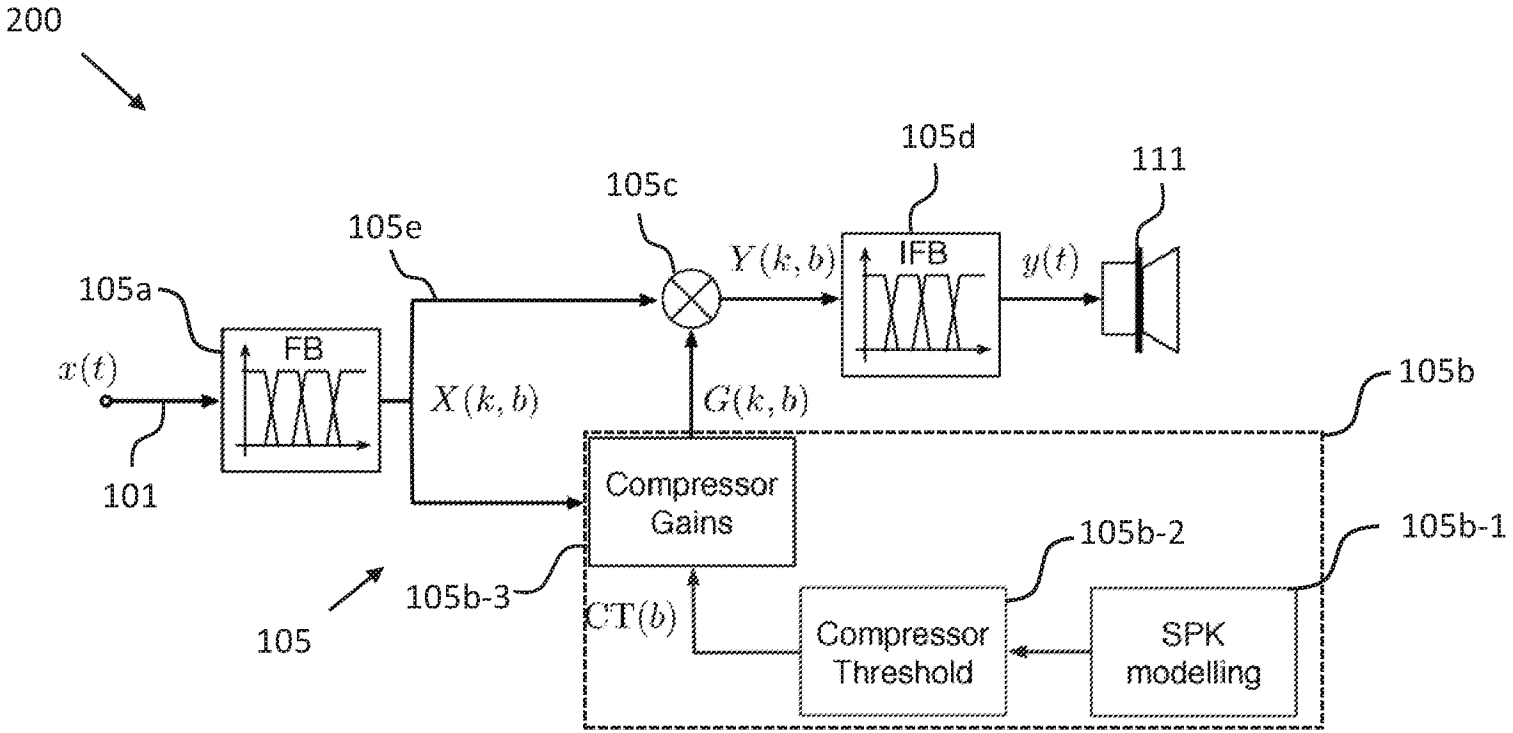
FIG. 2 shows a schematic diagram illustrating an audio signal processing stage comprising a low frequency control unit, which however is not covered by the appended claims.

FIG. 2 shows a schematic diagram illustrating an audio signal processing stage 200 comprising a low frequency control unit 105. The low frequency control unit 105 of the audio signal processing stage 200 shown in FIG. 2, or at least parts thereof, can be implemented in an audio signal processing stage according to an embodiment of the invention. In the example of FIG. 2, the low frequency control unit 105 comprises a filter bank 105*a* configured to separate the input audio signal 101 into a plurality of spectral audio signal components X(k,b) (referred to in this application as the input audio signal components), where k is the time and b is a band index. Depending on the details of the implementation, each spectral audio signal component may be provided in the form of an analog signal (e.g., a bandlimited signal output from a respective band-pass filter of the filter bank 105*a*) or digitally, e.g., in the form of digital samples or Fourier coefficients of the spectral audio signal component. The low frequency control unit 105 further comprises a plurality of band branches 105*e* for providing a corresponding plurality of output audio signal components Y(k, b). Only one of the band branches 105*e* is shown in the figure; the others (all connected parallel to the shown branch) are not represented for the sake of graphical simplicity. Each of the band branches 105*e* is configured to provide a respective one of the output audio signal components Y(k,b) on the basis of a respective one of the input audio signal components X(k,b). In other words, each band branch 105*e* processes an input audio signal component X(k,b) into a corresponding output audio signal component Y(k,b). Each input audio signal component X(k,b) is limited to a respective frequency band. In other words, the filter bank 105*a* makes a spectral decomposition of the input audio signal x(t), i.e. it decomposes x(t) (a time-domain signal) into the set of input audio signal components (which are time-domain signals, too).

In a variant (not shown), the filter bank 105*a* is instead configured to provide a set of spectral coefficients (input Fourier coefficients) rather than a set of time-domain signals. In this variant, the input Fourier coefficients are multiplied by respective compressor factors (or compressor gains) to produce a set of modified Fourier coefficients (output Fourier coefficients). An inverse filter bank 105*d* then synthesizes a time-domain signal on the basis of the output Fourier coefficients. Such variant may be implemented efficiently in a digital circuit, e.g., using a hard-coded fast Fourier transform (FFT).

Proceeding now with the description of the low frequency control unit 105 of the audio signal processing stage 200 shown in FIG. 2, each spectral component X(k,b) from the filter bank 105*a* is provided, as control input, to a compressor 105*b*. In the shown embodiment the compressor 105*b* comprises a loudspeaker modelling unit 105*b*-1 (referred to as "SPK modelling" in FIG. 2), a compressor threshold unit 105*b*-2 and a compressor gains unit 105*b*-3. A gain G (k,b) determined by the compressor gains unit 105*b*-3 adaptively for each band branch 105*e* is provided to a multiplication unit 105*c*. The multiplication unit 105*c* applies the gain to the input audio signal component X(k,b), thereby producing the output audio signal component Y(k,b), i.e. a boosted or attenuated spectral audio signal component. The output audio signal components from the plurality of band branches are summed in the inverse filter bank 105*d*, thus producing the output audio signal y(t). The output audio signal y(t) can be fed to the loudspeaker 111.

The low frequency control unit 105 of the audio signal processing stage 200 shown in FIG. 2 or at least parts thereof can be implemented in an audio signal processing stage according to an embodiment of the invention. In an embodiment, the input audio signal components X(k,b) correspond to spectral partitions b with respective bandwidths, e.g., mimicking the frequency resolution of the human auditory system. The partitions may be non-overlapping. In an embodiment, in order to adjust the level of the input audio signal within each partition b, a compression scheme can be applied in the compressor threshold unit 105*b*-2 of the compressor 105*b* shown in FIG. 2, e.g., making use of an estimate of a root-mean-square (RMS) value $P_x(k,b)$ for each partition b of the input audio signal x 101 (wherein $P_x(k,b)$ denotes the integral of the input audio signal components X(k,b) over the corresponding frequency range) and of a compression threshold value CT. The compression threshold value CT may be based, for example, on the maximum sound pressure level (SPL) of the loudspeaker 111, e.g., according to the following equation:

$$CT(b)=10\log_{10}(\psi_{SPK}f_b^{\gamma})-CT_0, \tag{2}$$

wherein $\psi_{SPK}$ denotes a constant representing properties of the physical components of the loudspeaker 111, y denotes an exponent applied to the center frequency $f_b$ of partition b (in an embodiment an adjustable parameter y can be used instead of setting it to a fixed value, such as a fixed value of 2, in order to keep more flexibility in the pressure versus frequency model), and $CT_0$ denotes a constant for further adjusting the compression threshold. Making use of the RMS value $P_x(k,b)$ and of equation 2, the compression gains (in decibel) can be determined in the compressor gains unit 105*b*-3 on the basis of the following equation:

$$G(k,b)=CS\cdot\min\{CT-10\log_{10}P(k,b),0\}, \tag{3}$$

wherein CS denotes the compression slope. As already mentioned above, each output audio signal component Y(k,b), i.e. each compressed audio input signal component, is obtained by multiplying the respective gain factor G (k,b) with the respective input audio signal component X(k,b), e.g., in the multiplication unit 105*c*, i.e. Y(k,b)=G(k,b)·X(k,b).

Figure 3:
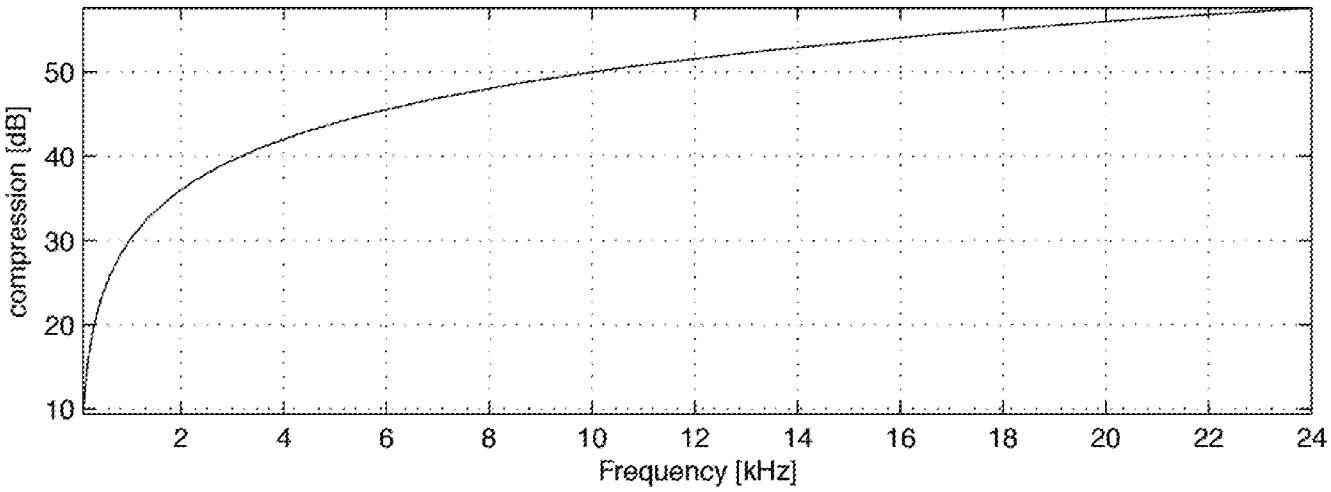
FIG. 3 shows an exemplary dependence of a compression threshold on frequency, which can be implemented in a low frequency control unit of an audio signal processing stage according to an embodiment.

FIG. 3 shows an exemplary dependence of the compression threshold on the center frequency of a partition, using the following exemplary values: $\psi_{SPK}=0.5$, $\gamma=2$, and $CT_0=-30$ dB, which could be implemented in the compressor threshold unit 105*b*-2 of the compressor 105*b* of an audio signal processing stage according to an embodiment of the invention. The curve shows the frequency dependence of the required compression threshold for an exemplified compact loudspeaker model using equation 2 with the given exemplary values.

Figure 4:
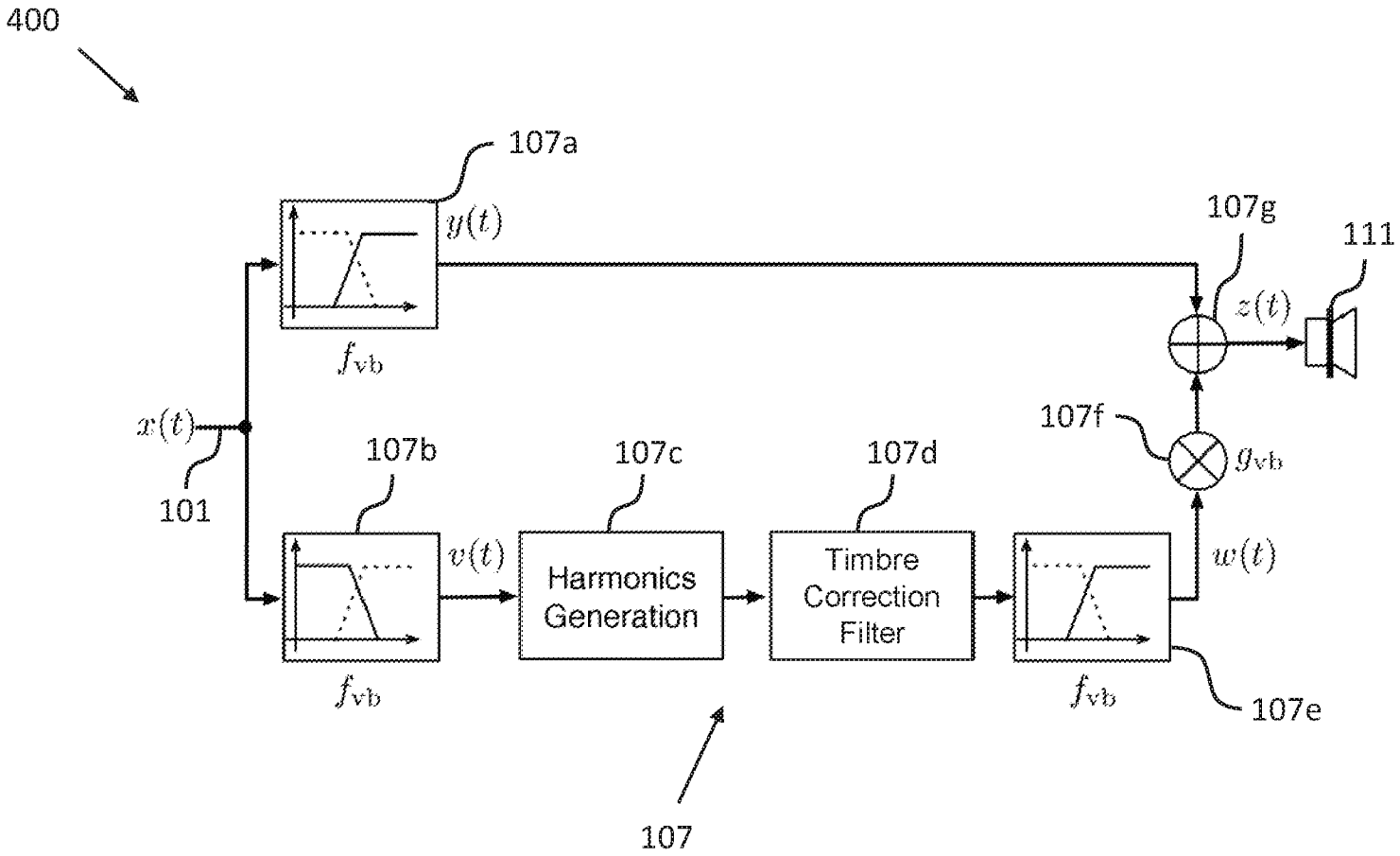
FIG. 4 shows a schematic diagram illustrating an audio signal processing stage comprising a virtual bass unit, which however is not covered by the appended claims.

FIG. 4 shows a schematic diagram illustrating an audio signal processing stage 400 comprising a virtual bass unit 107. The virtual bass unit 107 of the audio signal processing stage 400 shown in FIG. 4 or at least parts thereof can be implemented in an audio signal processing stage according to an embodiment of the invention.

The audio signal processing stage 400 comprises a high-pass filter branch having a high-pass filter 107*a* and a low-pass filter branch having a low-pass filter 107*b*. The low-pass filter branch further comprises a harmonics generator 107*c*, a timbre correction filter 107*d*, a further high-pass filter 107*e* and a multiplication unit 107*f* connected in series in this order. These components of the virtual bass unit 107 can be configured to operate in the following way.

The input audio signal x(t) 101 shown in FIG. 4 is split into two sub-band signals v(t) and y(t), e.g., by means of the low-pass filter 107*b* and the high-pass filter 107*a*, respectively. The low-pass filter 107*b* and the high-pass filter 107*a* can have the same cut-off frequency $f_{vb}$. In this case the residual signal is given by v(t)=x(t)−y(t).

The residual signal v(t) is further processed in a non-linear way in the harmonics generator 107*c* in order to generate harmonics of the residual signal v(t). The harmonics generator 107*c* can be configured to generate even harmonics, odd harmonics, or even and odd harmonics of the residual signal v(t).

Even harmonics can be generated, for example, using a second order multiplier on the basis of, for instance, the following equation:

$$v_{even}[n]=v[n]+g_{even}v^2[n], \tag{4}$$

wherein $g_{even}$ denotes an adjustable gain related to the amount or the power of the even harmonics and n denotes a discrete frequency index. On the basis of the fundamentals and the even harmonics, odd harmonics can then be generated using an odd harmonic generator based, for instance, on a soft clipping algorithm, as will be described in the following.

In a first step, two time estimates of the residual signal v(t) can be computed simultaneously, namely, for instance, an RMS (Root Mean Square) estimate $v_{rms}$ and a peak estimate $v_{peak}$.

The RMS estimate can be computed using the following equation:

$$v_{rms}[n]=\alpha_{rms}v_{rms}[n-1]+(1-\alpha_{rms})|v_{even}[n]|, \tag{5}$$

with $$\alpha_{rms}=\begin{cases}\alpha_{att:rms}, & \text{if } |v_{even}[n]|\geq v_{rms}[n-1]\\ \alpha_{rel:rms}, & \text{if } |v_{even}[n]|<v_{rms}[n-1].\end{cases} \tag{6}$$

The peak estimate can be computed using the following equation:

$$v_{peak}[n] = \alpha_{peak} v_{peak}[n-1] + (1-\alpha_{peak})|v_{even}[n]|, \quad (7)$$

with $$\alpha_{peak} = \begin{cases} \alpha_{att:peak}, & \text{if } |v_{even}[n]| \geq v_{even}[n-1] \\ \alpha_{relpeak}, & \text{if } |v_{even}[n]| < v_{even}[n-1]. \end{cases} \quad (8)$$

Both signal estimates $v_{rms}$ and $v_{peak}$ can be used to derive a compression curve, where the compression threshold can be adaptively defined as:

$$\mu_{CT}[n]=20 \log_{10}(v_{rms}[n])-\mu_{CT\,0}, \quad (9)$$

wherein $\mu_{CT0}$ denotes an additional threshold to adjust the effect of compression.

Figure 5:
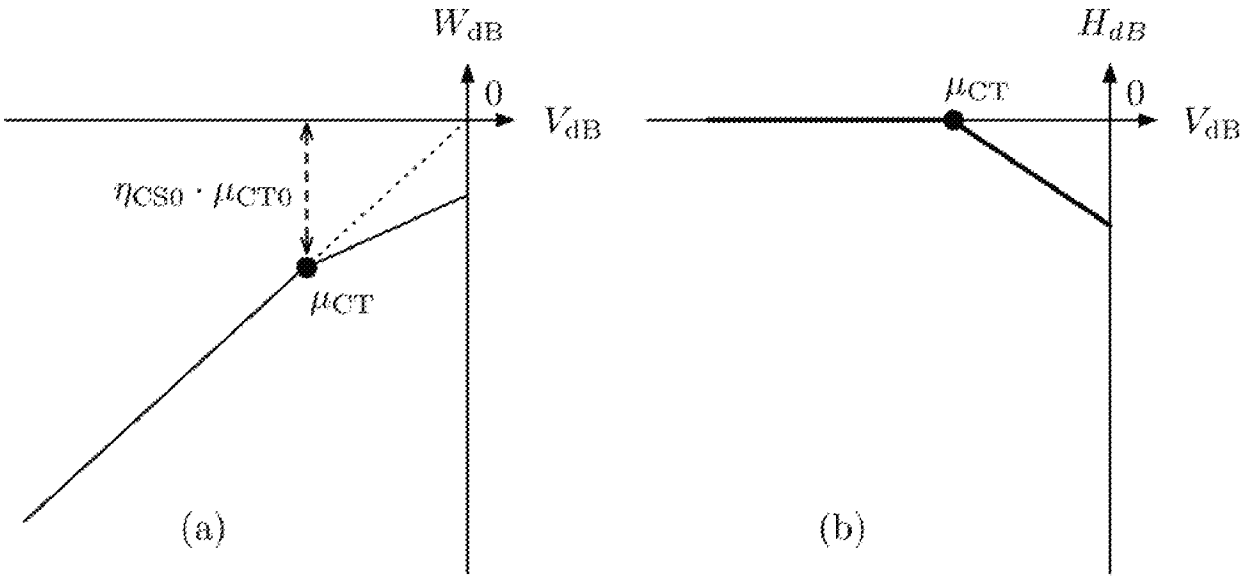
FIG. 5 shows schematic diagrams illustrating exemplary characteristics of a compression scheme, which can be implemented in a virtual bass unit of an audio signal processing stage according to an embodiment.

The compression gain (in decibel) can be computed using the following equation, for example:

$$h_{dB}[n]=-\eta_{CS0} \min\{20 \log_{10}(v_{peak}[n])-\mu_{CT}[n],0\}, \quad (10)$$

wherein $\eta_{CS\,0}$ denotes the compression slope as illustrated in FIG. 5, which shows characteristics of the compression scheme described above, which can be implemented in an audio signal processing stage according to an embodiment of the invention. Panel (a) of FIG. 5 shows the relation between the input level $V_{dB}$ in decibels and the output level $W_{dB}$ in decibels, whereas panel (b) of FIG. 5 shows the relation between the input level $V_{dB}$ in decibels and the output gain $H_{dB}$.

The output signal of the harmonics generator 107*c* shown in FIG. 4 can be computed according to the following equation:

$$w_C[n] = 10^{\frac{\eta_{CS0}-\mu_{CT0}}{20}} h[n] v_{even}[n], \quad (11)$$

wherein the factor $$10^{\frac{\eta_{CS0}-\mu_{CT0}}{20}}$$

is used to normalize the output signal with respect to the residual signal v and h[n] is the linear value of $h_{dB}[n]$. The output signal $w_c$ given in equation 11 contains all the harmonics of the residual signal v. Thus, the compression scheme described above, which can be implemented in an audio signal processing stage according to an embodiment of the invention, is not used to reduce the dynamic range of the signal, but rather to generate harmonics. The gains h defined in equation 10 can be smoothed over time to prevent artifacts due to values fluctuating over time.

As shown in FIG. 4, the output signal from the harmonics generator 107*c* can be supplied as input to the timbre correction filter 107*d*. The timbre correction filter 107*d* can be configured to further process the signal on the basis of the following equation:

$$w_T[n]=h_{timbre} * w_C[n], \quad (12)$$

wherein $h_{timbre}$ denotes an equalization filter. Thus a more pleasant timbre of the output audio signal z(t) can be achieved.

In order to suppress signal components with frequencies $f<f_{vb}$, the output signal from the timbre correction filter 107*d* can be filtered by means of the high-pass filter 107*e* using a low-cut filter $h_{high}$ with the cut-off frequency $f_{vb}$, i.e.

$$w_H[n]=h_{high} * w_T[n]. \quad (13)$$

Appropriate gains $g_{vb}$ can be applied to the filtered signal $w_H$ in the multiplication unit 107*f*, e.g., so as to obtain the loudness of the residual signal v, i.e.

$$w[n]=g_{vb}[n] w_H[n]. \quad (14)$$

The gains $g_{vb}$ can be further smoothed over time and be limited to prevent any extreme values.

Figure 6:
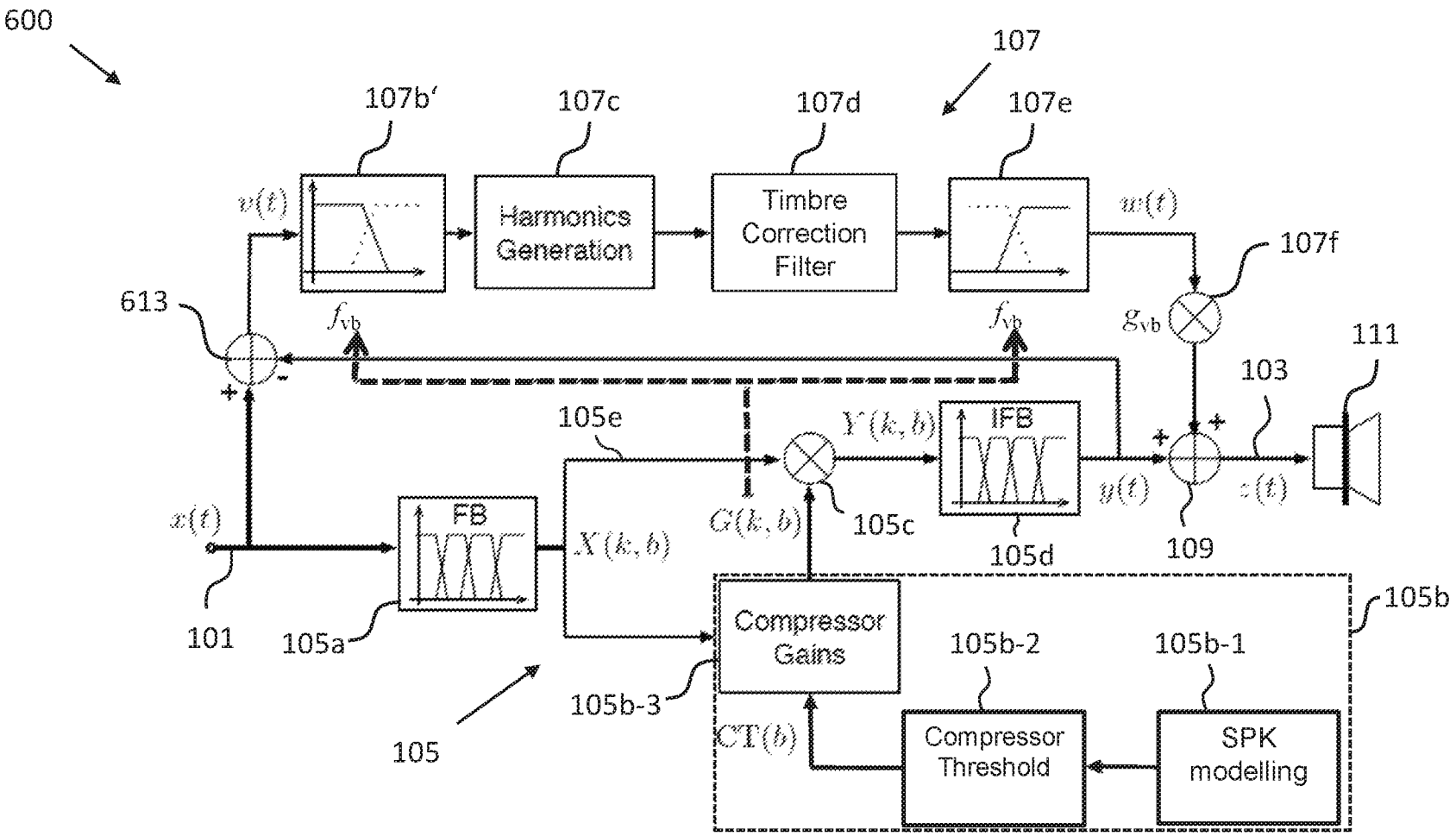
FIG. 6 shows a schematic diagram illustrating an audio signal processing stage according to an embodiment.

FIG. 6 shows an audio signal processing stage 600 according to an embodiment, comprising a low frequency control unit 105 and a virtual bass unit 107. The low frequency control unit 105 of the audio signal processing stage 600 comprises essentially the same arrangement of components as the low frequency control unit 105 of the audio signal processing stage 200 shown in FIG. 2, namely the filter bank 105*a*, the compressor 105*b*, the summation unit 105*c* and the inverse filter bank 105*d*. The compressor 105*b* comprises the loudspeaker modelling unit 105*b*-1, the compressor threshold unit 105*b*-2 and the compressor gains unit 105*b*-1. The virtual bass unit 107 of the audio signal processing stage 600 comprises similar components as the virtual bass unit 107 of the audio signal processing stage 400 shown in FIG. 4. More specifically, the virtual bass unit 107 of the audio signal processing stage 600 comprises a low-pass filter 107*b*', a harmonics generator 107*c*, a timbre correction filter 107*d*, a high-pass filter 107*e* and a multiplication unit 107*f*. It should be noted, however, that none of the initial low-pass filter 107*b*', the timbre correction filter 107*d*, and the further high-pass filter 107*e* is essential for implementing the invention and that in a variant of the shown example, one or more of these components is absent.

Thus, the processing of the input audio signal x(t) 101 by the low frequency control unit 105 of the audio signal processing stage 600 shown in FIG. 6 is similar or identical to the processing of the input audio signal x(t) 101 by the low frequency control unit 105 of the audio signal processing stage 200 shown in FIG. 2. Therefore, in order to avoid repetitions, reference is made to the above detailed description of the low frequency control unit 105 in the context of FIG. 2.

As can be taken from FIG. 6, the output signal y(t) provided by the inverse filter bank 105*d* of the low frequency control unit 105 is fed into a first input port of a residual audio signal generating unit 613. The residual audio signal generating unit 613 may be implemented as a summation unit or as subtraction unit. The input audio signal x(t) 101 is fed into another input port of the residual audio signal generating unit 613. The residual audio signal generating unit 613 generates as output a difference of these signals, i.e. the residual signal v(t)=y(t)−x(t). The residual signal v(t) is fed to the virtual bass unit 107. The virtual bass unit 107 processes the residual signal v(t) similarly to the way in which the virtual bass unit 107 of the audio signal processing stage 400 shown in FIG. 4 processes the input audio signal x(t) 101 of FIG. 4, with the distinction that in the example shown in FIG. 6, the low frequency control unit 105 determines a frequency $f_{vb}$ and sets $f_{vb}$ as the cut-off frequency of one or both of the low-pass filter 107*b*' and the high-pass filter 107*e* of the virtual bass unit 107. In one embodiment, the low frequency control unit 105 determines the cut-off frequency $f_{vb}$ on the basis of the compression gains G (k,b), as indicated by the dashed arrows in FIG. 6 In a particular embodiment, the low frequency control unit 105 determines the frequency $f_{vb}$ as $$f_{vb}(k) = \underset{f}{\operatorname{argmax}}\{G(k, f) \mid G(k, f) < \xi_{vb}\}. \quad (15)$$

The cut-off frequency of the high-cut filter 107*b*' and similarly the cut-off frequency of the low-cut filter 107*e* can thus be controlled through the threshold value $\xi_{vb}$. In an embodiment, the threshold value is chosen as $\xi_{vb}$=−6 dB. In a further embodiment, the cut-off frequency $f_{vb}$ is limited to a maximum value (e.g., $f_{vb}$<=500 Hz). The virtual bass unit 107 can thus be effectively disabled for frequencies above that maximum value.

In an embodiment, the multiplication unit 107*f* applies a gain $g_{vb}$ to the audio signal from the harmonics generator 107*c*, e.g., to the audio signal w(t) from the low-cut filter 107*e*. The gain $g_{vb}$ can be adjusted so as to preserve the loudness of the input signal v(t).

The summation unit 109 generates the final output signal z(t) 103 as the sum of the signals from the low frequency control unit 105 and the virtual bass unit 107. The output signal z(t) 103 can be fed to the loudspeaker 111 so as to drive the loudspeaker 111.

Figure 7:
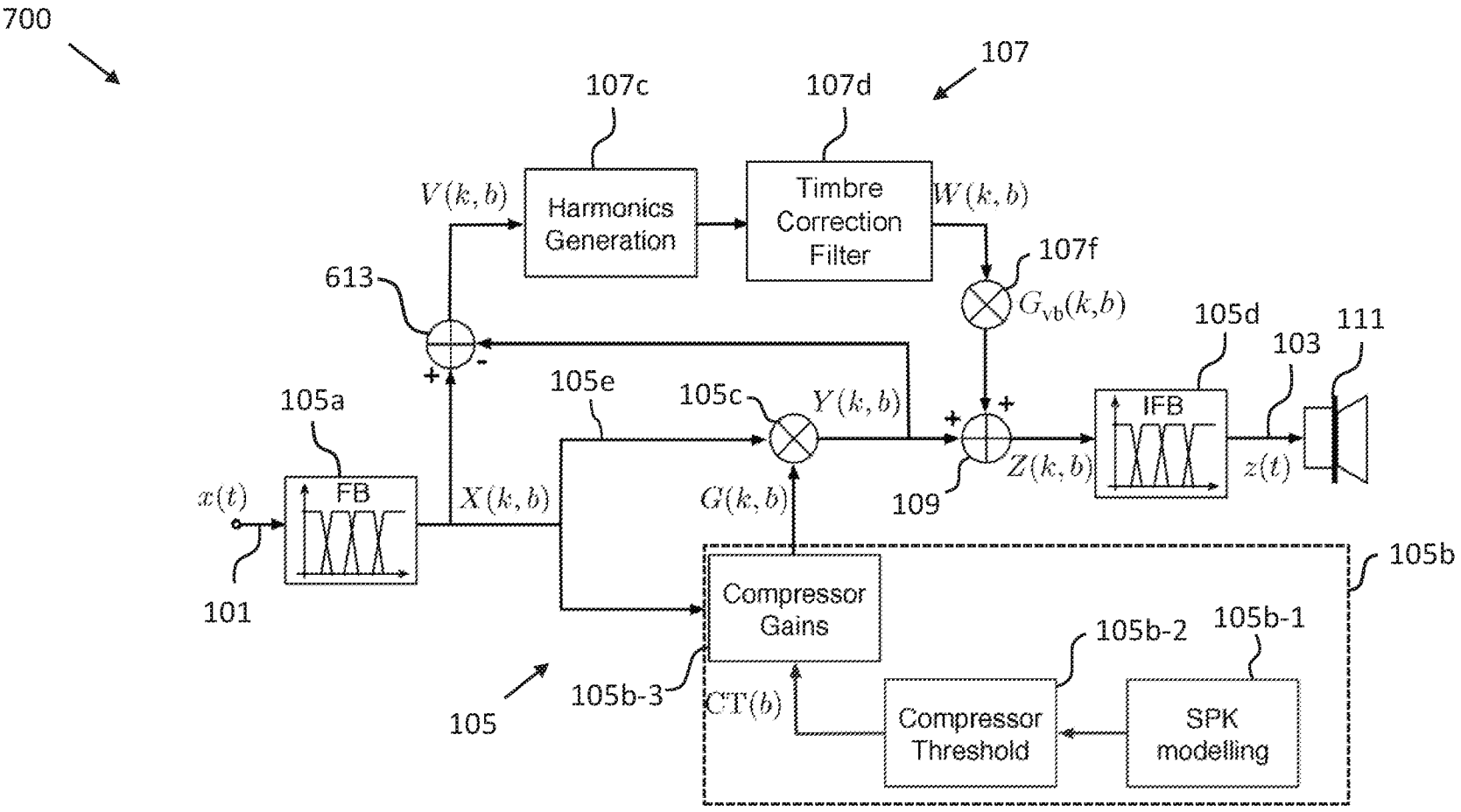
FIG. 7 shows a schematic diagram illustrating an audio signal processing stage according to an embodiment.

FIG. 7 shows an audio signal processing stage 700 according to a further embodiment comprising a low frequency control unit 105 and a virtual bass unit 107. In this embodiment the input signal x(t) 101 is provided to the filter bank 105*a* of the low frequency control unit 105 to generate the plurality of input audio signal components X(k,b). In this embodiment, each band branch 105*e* (i.e. each branch 105*e* from the filter bank 105*a* to the inverse filter bank 105*d*) comprises its own component of the virtual bass unit 107. In this embodiment, no cut-off frequency $f_{vb}$ is supplied from the low frequency control unit 105 to the virtual bass unit 107.

More specifically, the residual audio signal generating unit 613 of the audio signal processing stage 700 is configured to generate a plurality of residual audio signal components V(k,b) on the basis of the plurality of input audio signal components X(k,b) provided by the filter bank 105*a* and the plurality of output audio signal components Y(k,b) provided by the multiplication unit 105*c* of the low frequency control unit 105. As in the other embodiments, any of these audio signal components can be provided in various forms, analog as well as digital, depending on the details of the implementation, as already mentioned above with reference to FIG. 2. Note that each residual audio signal component V(k,b) is limited to the frequency band of the respective input audio signal component X(k,b). The virtual bass unit 107 of the audio signal processing stage 700 comprises the harmonics generator 107*c*, the timbre correction filter 107*d* and the multiplication unit 107*f*. These components operate essentially in the same way as the components of the virtual bass units 107 shown in FIGS. 4 and 6, the exception being that the components of the virtual bass unit 107 shown in FIG. 7 operate on the residual audio signal components V(k,b) and not on the whole residual audio signal v(t).

Figure 8:
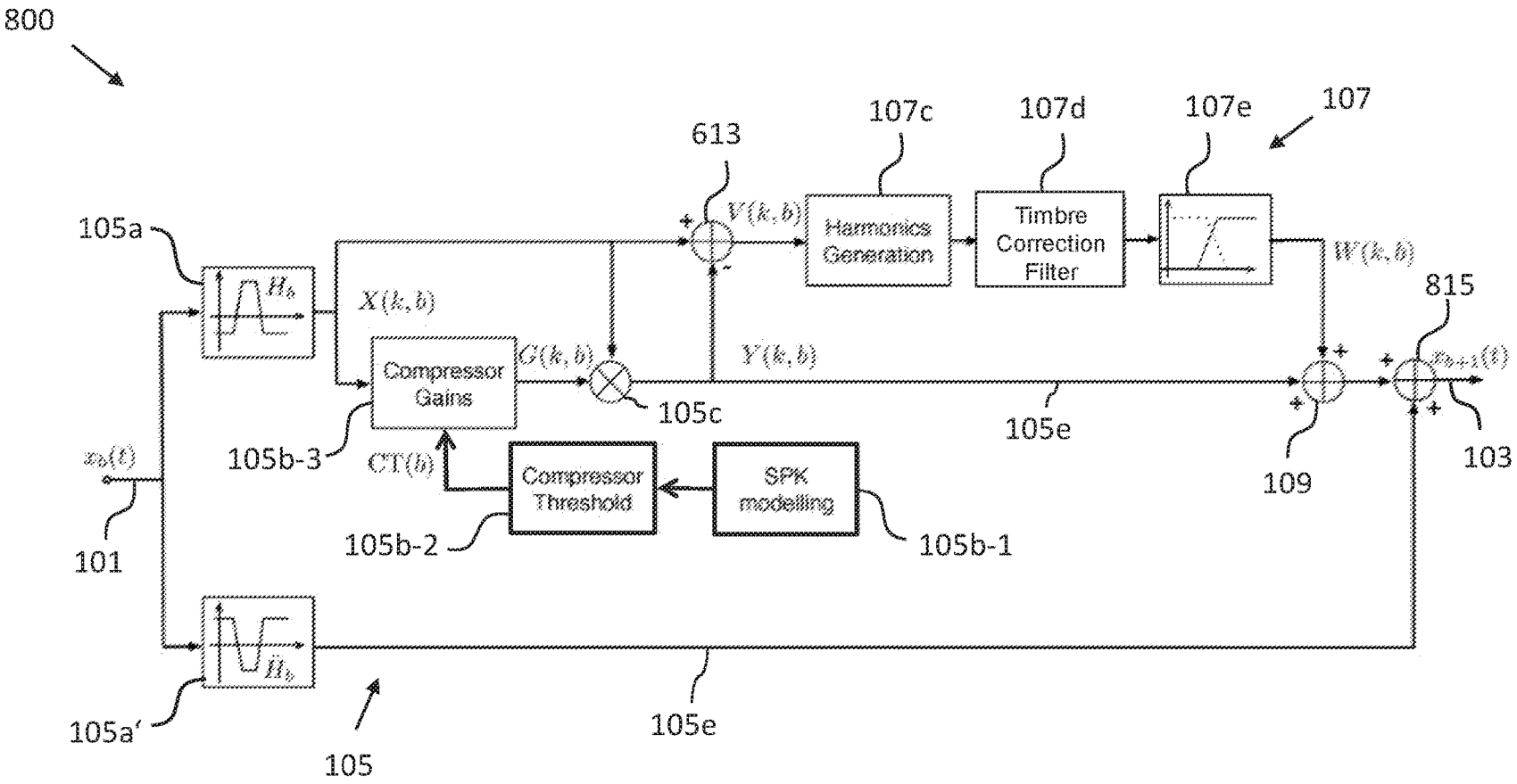
FIG. 8 shows a schematic diagram illustrating an audio signal processing stage according to an embodiment.

FIG. 8 shows an audio signal processing stage 800 according to a further embodiment, comprising a low frequency control unit 105 and a virtual bass unit 107. In this embodiment, there are only two band branches. In the shown example, the filter bank 105*a* of the low frequency control unit 105 is implemented in the form of a band-pass filter 105*a* and a band-stop filter 105*a*' complementary to the band-pass filter 105*a*. The band-pass filter 105*a* is configured to extract a first spectral audio signal component X(k,b) from the input signal $x_b$(t) 101. The first spectral audio signal component is to a first frequency band. The band-stop filter 105*a*' is configured to extract a second spectral audio signal component from the input signal $x_b$(t). The second spectral audio signal component comprises frequencies outside of the first frequency band.

Operation of the compressor 105*b* and the multiplication unit 105*c* of the low frequency control unit 105 shown in FIG. 8 is similar or identical to that of the compressor 105*b* and the multiplication unit 105*c* of the embodiment shown in FIG. 7. Similarly, operation of the residual signal generating unit 613 and the virtual bass unit 107 shown in FIG. 8 is similar or identical to the operation of the residual signal generating unit 613 and the virtual bass unit 107 shown in FIG. 7, with the exception that the virtual bass unit 107 shown in FIG. 8 comprises (in addition to the harmonics generator 107*c* and the timbre correction filter 107*d*) the high-pass filter 107*e* but not the multiplication unit 107*f*.

The summation unit 109 is configured to sum the attenuated spectral audio signal component or coefficient Y(k,b) from the multiplication unit 105*c* and the spectral audio signal component W(k,b) from the high-pass filter 107*e*. A further summation unit 815 is configured to sum the output of the summation unit 109 and the output of the band-stop filter 105*a*'. The summation units 109 and 815 together form a combining unit 109, 815 which sums the output audio signal component of the first band branch (connected to the band-pass filter 105*a*) and the output audio signal component of the second band branch (connected to the band-stop filter 105*a*').

In an embodiment, a further audio signal processing stage (not shown in FIG. 8) is connected to the output of the audio signal processing stage 800, the output signal $x_{b+1}$(t) of the audio signal processing stage 800 (first stage) becoming the input signal of the further audio signal processing stage (second stage). The second stage may be similar to the first stage 800 shown in FIG. 8, with the difference that the second stage compresses the audio signal and adds a virtual bass signal in a higher frequency band than the first stage.

Figure 9:
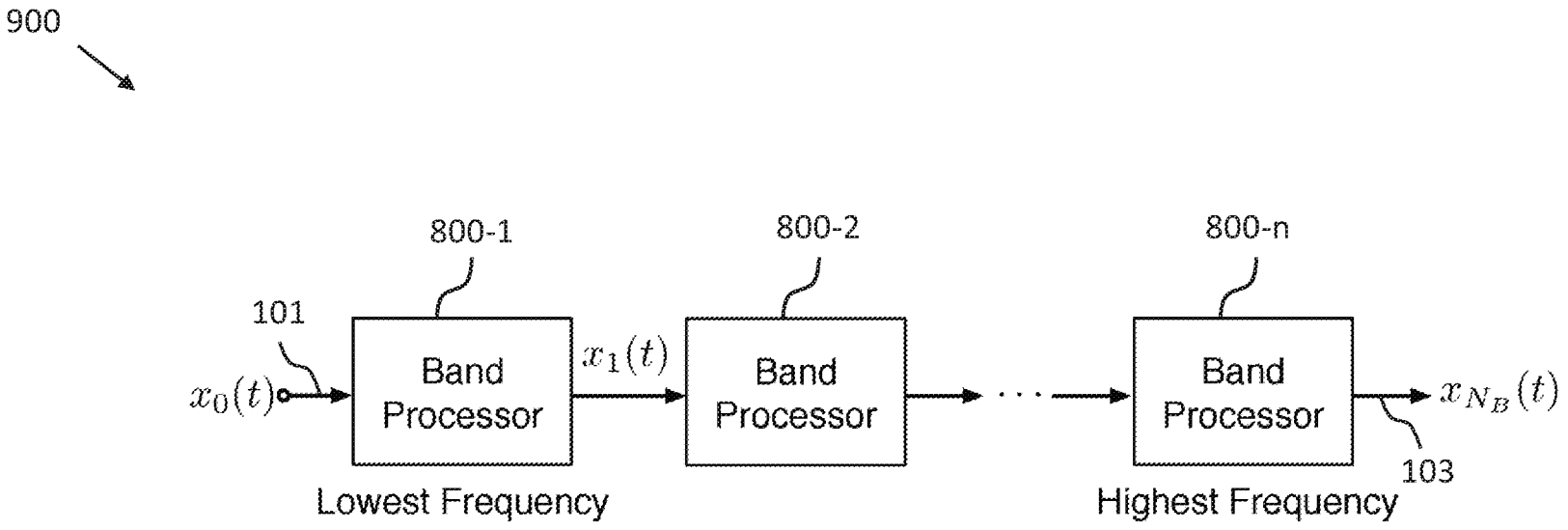
FIG. 9 shows a schematic diagram illustrating an audio signal processing apparatus comprising a plurality of audio signal processing stages according to an embodiment and implementing an iterative processing scheme.

An embodiment of an audio signal processing apparatus 900 comprising several audio signal processing stages 800-1, . . . , 800-*n* connected in series and operating in frequency bands with increasing frequencies is illustrated in FIG. 9. The audio signal processing stages 800-1, . . . , 800-*n* can each be similar or identical to the audio signal processing stage 800 shown in FIG. 8. In an embodiment, the first stage 800-1 processes the audio input signal 101 in a frequency range [$f_0$, $\beta \cdot f_0$], the second stage 800-2 processes the audio signal from the first stage 800-1 in a frequency range [$\beta \cdot f_0$, $\beta^2 \cdot f_0$], and so on, wherein $f_0$ denotes a predefined lower boundary frequency, such as 20, 50 or 100 Hz, and 0 denotes a width parameter greater than 1, in particular $1<\beta\leq 2$. Thus, each frequency band can be chosen sufficiently narrow so that all second (and higher) harmonics will lie in higher bands and can thus be processed by the subsequent audio signal processing stage of the apparatus 900. Choosing a value of 0 close to 2, such as $1.8\leq\beta\leq 2$, may be particularly economic, as less audio signal processing stages may then be necessary to cover the whole frequency spectrum of the input audio signal 101. In an embodiment, the total number of audio signal processing stages 800-1, . . . , 800-*n* of the audio signal processing apparatus 900 is adapted or adaptable to the Nyquist frequency.

Embodiments of the present invention allow for controlling the level of the output audio signal depending on the geometry or size of the loudspeaker. This will directly influence the rendition of the signal at a particular frequency. Furthermore, the gain of the output audio signal is adjusted so that it will not exceed the maximum sound pressure level of the loudspeaker.

Moreover, embodiments of the present invention allow for enhancing the perception of low frequency audio signals by compressing low frequency components and generating harmonics of that part of the input audio signal that is suppressed by the compression treatment. In particular, the virtual bass unit can ensure an acceptable level of perceived bass in loudspeakers that have not been designed for low frequencies.

Moreover, embodiments of the present invention allow for an adaptive setting of the cut-off frequency in accordance with the signal content and loudspeaker capability.

Moreover, there will be no or less perceived loss of low frequency content compared to many earlier methods, due to the use of a virtual bass bandwidth extension, which substitutes the low frequencies by the corresponding higher harmonics. The virtual bass bandwidth extension performance is improved by driving it with the help of the low frequency control unit.

Moreover, embodiments of the invention allow for a serial implementation of the low frequency control unit and the virtual bass unit, involving a series of two or more audio signal processing stages. An advantage of the serial implementation is that overshoots of the loudspeaker limits by harmonics can be avoided. Note that some earlier virtual bass bandwidth extension methods can be problematic in that the generated harmonics which are added to the original signal may overdrive the loudspeaker. In the serial scheme, in contrast, the generated harmonics are attenuated as required in a subsequent stage. Furthermore, the iterative implementation has the advantage that the cutoff frequency does not need to be set explicitly by the low frequency control unit.

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein. Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the invention beyond those described herein. While the present invention has been described with reference to one or more particular embodiments, those skilled in the art recognize that many changes may be made thereto without departing from the scope of the present invention. It is therefore to be understood that within the scope of the appended claims and their equivalents, the invention may be practiced otherwise than as specifically described herein.

What is claimed is:

1. An audio signal processing stage for processing an input audio signal into an output audio signal, wherein the audio signal processing stage comprises:

a filter bank defining two or more frequency bands, the filter bank being configured to separate the input audio signal into two or more input audio signal components, each of the two or more input audio signal components being limited to a respective one of the two or more frequency bands;

a set of two or more band branches configured to provide two or more output audio signal components, wherein each of the two or more band branches is configured to process a respective one of the two or more input audio signal components to provide a respective one of the two or more output audio signal components, wherein the set of two or more band branches comprises one or more compressor branches, each of the one or more compressor branches comprising a compressor configured to compress the input audio signal component of the respective compressor branch to provide the output audio signal component of the respective compressor branch;

an inverse filter bank configured to generate a summed audio signal by summing the two or more output audio signal components;

a residual audio signal generating unit configured to generate a residual audio signal, the residual audio signal being a difference between the input audio signal and the summed audio signal;

a virtual bass unit configured to generate a virtual bass signal which comprises one or more harmonics of the residual audio signal, the virtual bass unit comprising a harmonics generator configured to generate the one or more harmonics on the basis of the residual audio signal; and a summation unit configured to generate the output audio signal by summing the summed audio signal and the virtual bass signal.

2. An audio signal processing stage for processing an input audio signal into an output audio signal, wherein the audio signal processing stage comprises:

a filter bank defining two or more frequency bands, the filter bank being configured to separate the input audio signal into two or more input audio signal components, each of the two or more input audio signal components being limited to a respective one of the two or more frequency bands;

a set of two or more band branches configured to provide two or more output audio signal components, wherein each of the two or more band branches is configured to process a respective one of the two or more input audio signal components to provide a respective one of the two or more output audio signal components; and an inverse filter bank configured to generate the output audio signal by summing the two or more output audio signal components;

wherein the set of two or more band branches comprises one or more compressor branches, each of the compressor branches comprising:

a compressor configured to generate a compressed audio signal component by compressing the input audio signal component of the respective compressor branch;

a residual audio signal component generating unit configured to generate a residual audio signal component, the residual audio signal component being a difference between the input audio signal component of the respective compressor branch and the compressed audio signal component;

a virtual bass unit configured to generate a virtual bass signal component which comprises one or more harmonics of the residual audio signal component, the virtual bass unit comprising a harmonics generator configured to generate the one or more harmonics on the basis of the residual audio signal component; and a summation unit configured to generate the output audio signal component of the respective compressor branch by summing the compressed audio signal component and the virtual bass signal component.

3. The audio signal processing stage of claim 1, wherein the set of two or more band branches further comprises one or more non-compressive branches.

4. The audio signal processing stage of claim 1, wherein the set of two or more band branches comprises precisely one compressor branch.

5. The audio signal processing stage of claim 1, wherein the virtual bass unit comprises a timbre correction filter configured to apply a timbre correction to the one or more harmonics.

6. The audio signal processing stage of claim 1, wherein the compressor comprises one or more of a compressor gains unit, a compressor threshold unit, and a loudspeaker modelling unit.

7. The audio signal processing stage of claim 1, wherein the one or more harmonics comprise one or more even harmonics of the residual audio signal or residual audio signal component.

8. The audio signal processing stage of claim 7, wherein the one or more harmonics comprise one or more odd harmonics of the residual audio signal or residual audio signal component.

9. The audio signal processing stage of claim 1, wherein the virtual bass unit comprises one or both of a low pass filter and a high pass filter, wherein the low pass filter is connected between the residual audio signal generating unit and the harmonics generator and wherein the high pass filter is connected between the harmonics generator and the summation unit.

10. The audio signal processing stage of claim 9, wherein the compressor is configured to adjust one or both of a cut-off frequency of the low pass filter and a cut-off frequency of the high pass filter.

11. An audio signal processing apparatus comprising a first and a second audio signal processing stage as set forth in claim 1, wherein the first and second audio signal processing stages are connected in series, the output audio signal of the first audio signal processing stage being the input audio signal of the second audio signal processing stage.

12. The audio signal processing apparatus of claim 11, wherein the one or more frequency bands defined by the filter bank of the second audio signal processing stage comprise all or some of the harmonics generated in the first audio signal processing stage.

13. An audio signal processing method for processing an input audio signal into an output audio signal, wherein the audio signal processing method comprises:

separating the input audio signal into two or more input audio signal components by means of a filter bank, the filter bank defining two or more frequency bands, each of the two or more input audio signal components being limited to a respective one of the two or more frequency bands;

providing two or more output audio signal components on the basis of the two or more input audio signal components by means of a set of two or more band branches, wherein each of the two or more band branches provides a respective one of the two or more output audio signal components on the basis of a respective one of the two or more input audio signal components, wherein the set of two or more band branches comprises one or more compressor branches, each of the one or more compressor branches comprising a compressor that compresses the input audio signal component of the respective compressor branch to provide the output audio signal component of the respective compressor branch;

generating a summed audio signal by summing the two or more output audio signal components;

generating a residual audio signal which is a difference between the input audio signal and the summed audio signal;

generating a virtual bass signal which comprises one or more harmonics of the residual audio signal, by generating the one or more harmonics on the basis of the residual audio signal; and generating the output audio signal by summing the summed audio signal and the virtual bass signal.

14. An audio signal processing method for processing an input audio signal into an output audio signal, wherein the audio signal processing method comprises:

separating the input audio signal into two or more input audio signal components by means of a filter bank, the filter bank defining two or more frequency bands, each of the two or more input audio signal components being limited to a respective one of the two or more frequency bands;

providing two or more output audio signal components on the basis of the two or more input audio signal components by means of a set of two or more band branches, wherein each of the two or more band branches provides a respective one of the two or more output audio signal components on the basis of a respective one of the input audio signal components, wherein the set of two or more band branches comprises one or more compressor branches, each of the one or more compressor branches comprising a compressor which generates a compressed audio signal component by compressing the input audio signal component of the respective compressor branch, a residual audio signal component generating unit which generates a residual audio signal component which is a difference between the input audio signal component of the respective compressor branch and the compressed audio signal component, a virtual bass unit which generates a virtual bass signal component comprising one or more harmonics of the residual audio signal component, by generating the one or more harmonics on the basis of the residual audio signal component, and a summation unit which generates the output audio signal component of the respective compressor branch by summing the compressed audio signal component and the virtual bass signal component; and generating the output audio signal by summing the two or more output audio signal components.

15. A non-transitory computer-readable storage medium in which a program code is stored which when executed on a computer causes the computer to perform the method of claim 13.

* * * * *